US008424707B2

(12) United States Patent
Bassett et al.

(10) Patent No.: US 8,424,707 B2
(45) Date of Patent: Apr. 23, 2013

(54) LIQUID STORAGE TANK WITH INTERNAL FLOW CONTROL BAFFLE AND METHODS

(75) Inventors: Laurence W. Bassett, Killingworth, CT (US); Nathan E. Marks, Rosemount, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 401 days.

(21) Appl. No.: 12/739,762

(22) PCT Filed: Oct. 16, 2008

(86) PCT No.: PCT/US2008/080080

§ 371 (c)(1), (2), (4) Date: Apr. 26, 2010

(87) PCT Pub. No.: WO2009/055291

PCT Pub. Date: Apr. 30, 2009

(65) Prior Publication Data

US 2010/0270327 A1 Oct. 28, 2010

Related U.S. Application Data

(60) Provisional application No. 60/982,946, filed on Oct. 26, 2007.

(51) Int. Cl.
*B65D 90/02* (2006.01)

(52) U.S. Cl.
USPC ..... 220/563; 62/98

(58) Field of Classification Search ..... 220/501, 220/563, 565, 577; 62/98, 99
See application file for complete search history.

(56) References Cited

U.S. PATENT DOCUMENTS

| | | | | |
|---|---|---|---|---|
| 3,521,703 | A | 7/1970 | Koziara | |
| 3,834,178 | A | 9/1974 | Pink | |
| 3,898,856 | A | 8/1975 | Komedera | |
| 4,036,620 | A | 7/1977 | Benasutti | |
| 4,204,573 | A * | 5/1980 | Clark | 165/142 |
| 4,550,771 | A * | 11/1985 | Arbabian | 165/47 |
| 4,608,261 | A | 8/1986 | Mackenzie | |
| 5,404,730 | A | 4/1995 | Westermeyer | |
| 2004/0007516 | A1 | 1/2004 | Fritze | |
| 2005/0160759 | A1 | 7/2005 | Chaney | |

FOREIGN PATENT DOCUMENTS

| | | |
|---|---|---|
| JP | 2001-041631 | 2/2001 |
| KR | 2003-16943 | 6/2003 |
| KR | 2006-0131450 | 2/2006 |
| WO | 01/16017 | 3/2001 |

OTHER PUBLICATIONS

EP Search Report for International Application No. PCT/US2008/080080—May 2009.

* cited by examiner

*Primary Examiner* — Harry Grosso
(74) *Attorney, Agent, or Firm* — Scott A. Baum

(57) ABSTRACT

A liquid storage tank assembly includes a baffle member and a tank assembly. The baffle member includes a generally helical or spiral shaped portion. The baffle member defines a spiral flow path between inlet and outlet openings of the tank assembly. When the baffle member is positioned within the tank and the tank assembly holds a volume of a first liquid, input of a supply of a second liquid at the inlet to the tank assembly forces the first liquid along the spiral flow path and out of the tank assembly exit without substantial mixing of the first and second liquids before substantially all of the first liquid has been dispensed.

18 Claims, 11 Drawing Sheets

LIQUID STORAGE TANK WITH INTERNAL FLOW CONTROL BAFFLE AND METHODS

CROSS REFERENCE TO RELATED APPLICATIONS

This application is a national stage filing under 35 U.S.C. §371 of PCT/US2008/080080, filed Oct. 16, 2008, which claims priority to Provisional Application No. 60/982,946, filed Oct. 26, 2007, the disclosure of which is incorporated by reference in its/their entirety herein.

TECHNICAL FIELD

The present disclosure generally relates to liquid storage devices, and more particularly relates to refrigerated water reservoir assemblies having flow control features.

BACKGROUND

Water storage and water filtration in commercial and consumer refrigerators has become more common. Many consumers prefer having the option of dispensing chilled, filtered water from their refrigerator. The refrigerated space defined by the refrigerator is used to chill a volume of water stored in the refrigerator. The stored volume of water can be positioned upstream or downstream from a water filter. The stored volume of water in the liquid storage tank can be located within the refrigerated space. A need exists for improved liquid storage tank configurations that maximize the amount of chilled water and minimize the volume occupied by the tank within the refrigerated space. It is desirable to achieve these improvements without adversely affecting water pressure drop.

SUMMARY

One aspect of the present disclosure relates to a liquid storage tank assembly that is operational under variable supply line pressure conditions up to a high pressure condition, and maximizes dispensing of a volume of a first liquid in the liquid storage tank upon influx of a supply of a second liquid to the storage tank. An example liquid storage tank assembly includes a baffle member and a tank assembly. The baffle member has a generally helical or spiral shaped portion that defines a spiral flow path between inlet and outlet openings of the tank. When the baffle member is positioned within the tank assembly and the tank assembly holds a volume of the first liquid, input of a supply of the second liquid at the inlet to the tank assembly forces the first liquid along the spiral flow path and out of the tank assembly exit without substantial mixing of the first and second liquids.

Related methods of assembly, manufacture, water dispensing, and control of internal liquid flow in a liquid storage tank are some further aspects of the present disclosure.

The above summary is not intended to describe each disclosed embodiment or every implementation of the inventive aspects disclosed herein. Figures of the detailed description that follow more particularly describe features that are examples of how certain inventive aspects may be practiced. While certain embodiments are illustrated and described, it will be appreciated that the disclosure is not limited to such embodiments or arrangements.

DETAILED DESCRIPTION

Figure 1:
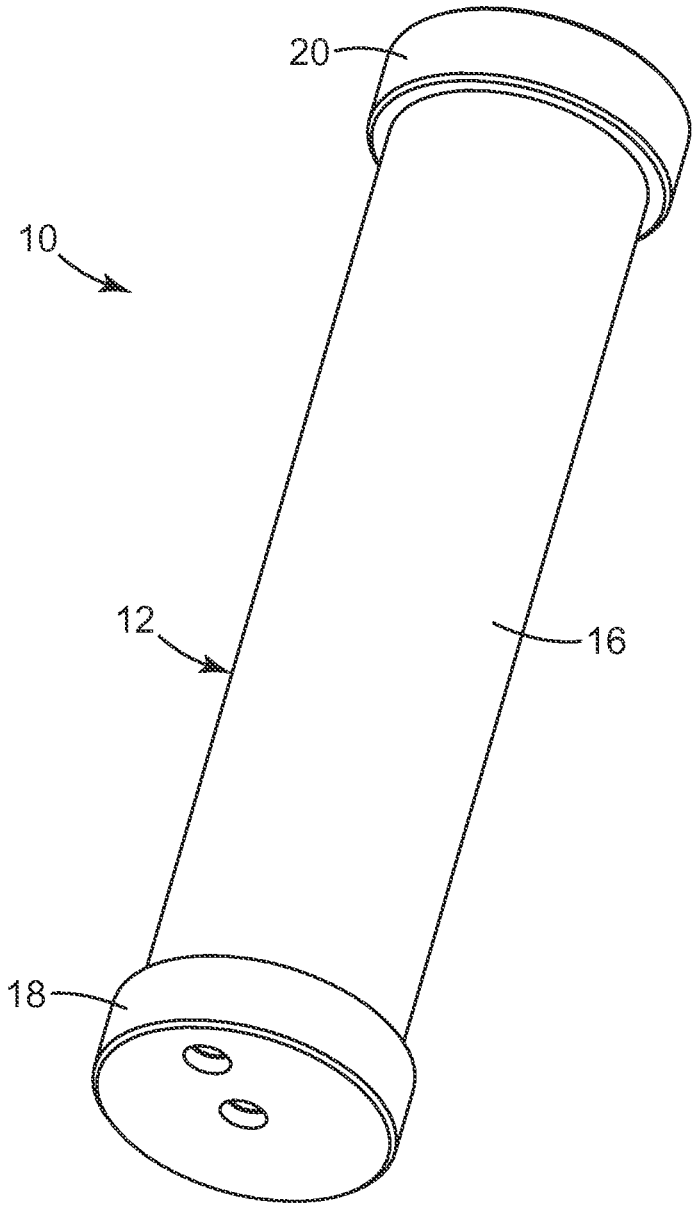
FIG. 1 is a schematic perspective view of an example liquid storage tank assembly in accordance with principles of the present disclosure.

Various embodiments will be described in detail with reference to the drawings, wherein like reference numbers represent like parts in assemblies throughout the several views. Reference to various embodiments does not limit the scope of the claims attached hereto. Additionally, any examples set forth in this specification are not intended to be limiting and merely set forth some of the many possible embodiments for the appended claims.

The following discussion is intended to provide a brief, general description of a suitable environment in which the invention may be implemented. Although not required, the invention will be described in the general context of a water storage tank assembly, for example, a water storage tank used in a consumer refrigerator. The structure, creation, and use of some example liquid storage tank assemblies and methods are described hereinafter.

The example embodiments disclosed herein have wide application to a number of liquid storage applications beyond the refrigerator application emphasized herein. Internal flow control features in a liquid storage tank has many applications in a variety of environments outside of a refrigerator environment. While such alternative applications and environments are possible, emphasis is placed on the application of water storage and water dispensing from a consumer refrigerator, as that particular application is particularly benefited from the embodiments described herein with reference to the attached figures.

In a consumer refrigerator, any portion of the refrigerated space defined by the refrigerator that is used by a water storage tank reduces the otherwise available refrigerated space used for the consumer's food. One object of the water storage tank is to hold a volume of chilled water that can be readily available for the consumer's drinking needs. An example volume of chilled water desired is an amount sufficient for a family's drinking needs at any given meal. A volume of chilled water in the refrigerated space greater than that amount can unnecessarily reduce the food storage volume in the refrigerated space of the refrigerator. Thus, the ratio of total volume of space defined by the tank to the volume of water held in the tank is a measurement that indicates volume efficiency in the refrigerated space.

Another consideration related to the storage of chilled water in a refrigerator is the rate at which the chilled water can be dispensed. The rate of dispensing is influenced by a number of variables including the available water pressure. A water storage tank that provides a minimum decrease in water pressure between the water supply line into the refrigerator and the point of dispensing of the chilled water can be advantageous. In some cases, the water supply line that feeds the water storage tank provides water at a relatively high pressure. The water pressure in the water supply line can vary from one location (e.g., house, building or community) to another. Consequently, a water control valve (e.g., a pressure limiting valve) is optionally positioned in the supply line upstream of the filter and water storage tank in the refrigerated space to provide a water pressure within a relatively consistent range of pressures. U.S. Pat. No. 3,834,178 (Pink) discloses an example water control valve and water storage tank. Removing the water control valve exposes the water storage tank to the water pressure conditions of the supply line.

Another consideration related to the storage of chilled water in a refrigerator is maintaining a predetermined minimum water temperature for a given volume of water dispensed.

The use of a spiral or helical shaped baffle in the example water storage tank assemblies described hereinafter address at least some of those considerations described above related to the storage of water in a consumer refrigerator. For example, the disclosed water storage tank assemblies are adapted to perform under a variety of water supply pressure conditions ranging from low pressure conditions to relatively high water pressure conditions. Further, the size of the water storage tank assemblies optimizes the ratio of chilled water to volume of the storage tank, thereby minimizing impact on food storage space in a refrigerated space of the refrigerator. Still further, the spiral shaped baffle of the example water storage assemblies results in a "first in, first out" flow of chilled water from the storage tank, wherein substantially all of the chilled water can be dispensed from the water storage tank while maintaining a desired minimum water temperature for the dispensed water.

The Example Liquid Storage Tank Assembly of FIGS. 1-5

An example liquid storage tank assembly 10 is shown and described with reference to FIGS. 1-5. The liquid storage tank assembly 10 includes a tank assembly 12 and a baffle assembly 14. The tank assembly 12 includes a body 16 and first and second end caps 18, 20. The end caps 18, 20 can also be referred to as first and second end portions 18, 20 of the tank assembly 12. The body 16 includes first and second open ends 22, 24, an inner volume 26 defined within the body 16, an outer peripheral surface 28, and an inner surface 30. The body 16 has a cylindrical shape along its length. The body 16 is shown having a generally circular cross-section. The cross-section of body 16 remains constant along its length. In other arrangements, the body 16 can have different cross-sectional shapes such as, for example, oval or any desired polygonal shape (e.g., hexagon, pentagon, octagon). Further, the outer peripheral surface 28 can have a different cross-sectional shape from an internal surface of the body 16. In one example (not shown), the outer peripheral surface 28 has a polygonal shape (e.g., octagonal shape) while the inner surface 30 maintains a circular shape.

The first end cap 18 includes a first liquid aperture 32 and a first pass through aperture 34. The second end cap 20 includes a second liquid aperture 36, and a second pass through aperture 38. The first and second end caps 18, 20 illustrated in FIGS. 1-4 are structured similarly with a generally cylindrical construction. An inner surface 37 (see FIG. 2) of the end caps 18, 20 are sized to mate with the outer peripheral surface 28 of the body 16. Each of the caps 18, 20 includes an end wall 33 (see FIG. 2). The end walls 33 are shown having a generally planar surface on an interior side and an exterior side of the caps 18, 20. In other examples, the end walls 33 can include non-planar shapes such as, for example, a contoured shape such as a hollow hemispherical shape.

The first and second end caps 18, 20 can be constructed as separate pieces that are secured to the body 16, for example, after positioning of the baffle assembly 14 within the inner volume 26 of the body 16. In some examples, at least one of the end caps 18, 20 is formed integral with the body 16 using, for example, casting, injection molding, or co-molding.

Figure 3:
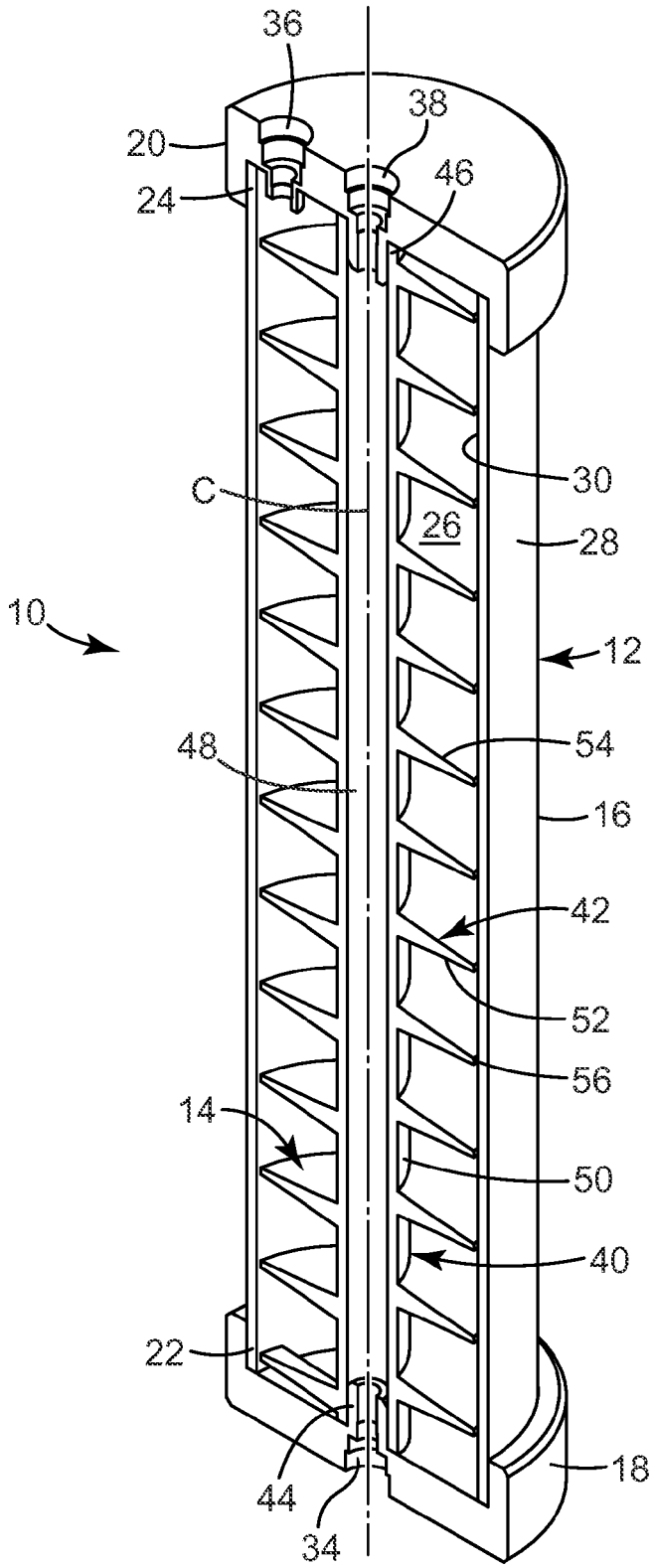
FIG. 3 is a schematic cross-sectional perspective view of the example liquid storage tank assembly shown in FIG. 1.
Figure 4:
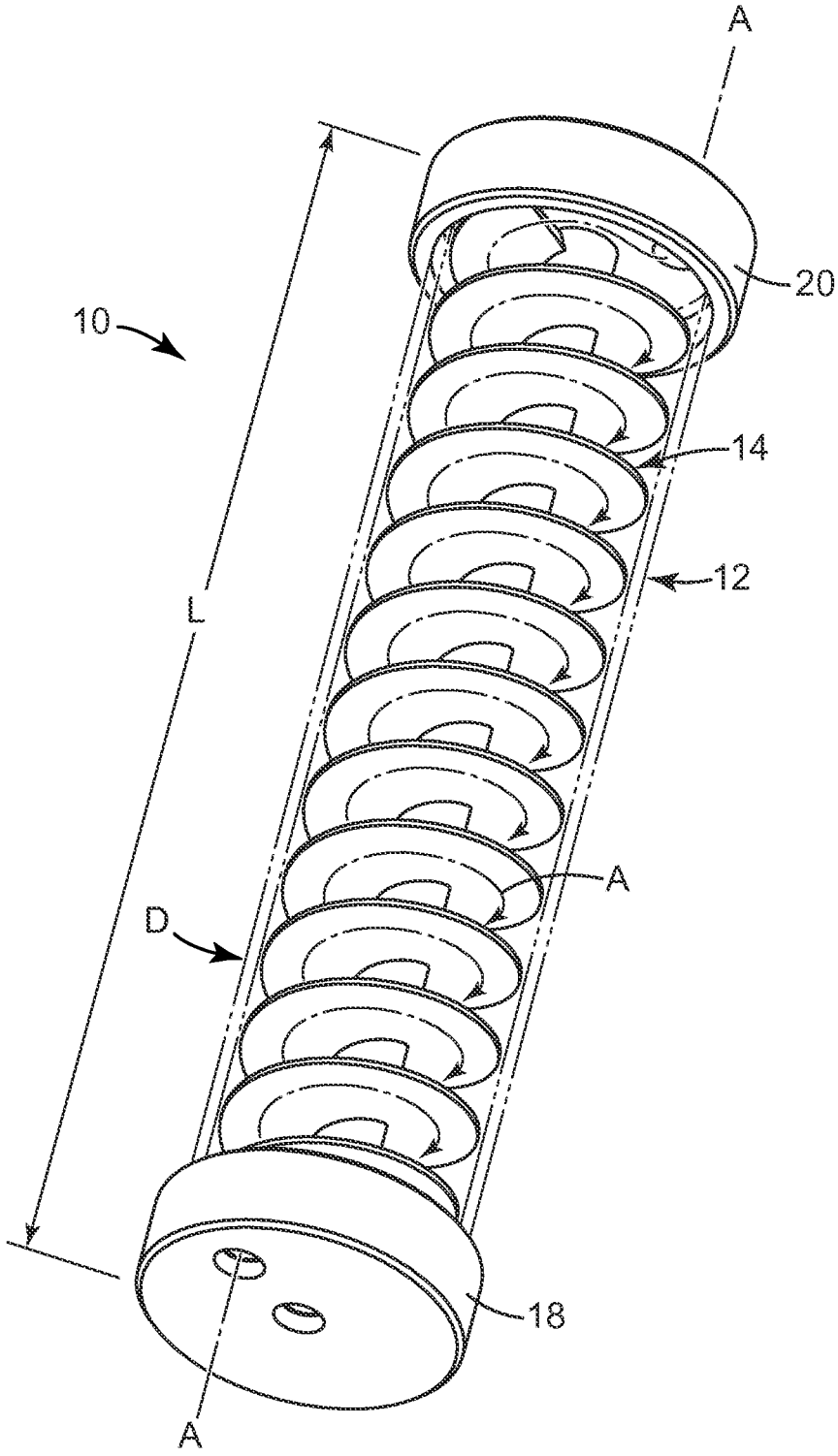
FIG. 4 is a schematic perspective view of the example liquid storage tank assembly shown in FIG. 1 with portions of the tank assembly body shown opaque to illustrate an example liquid flow through the liquid storage tank assembly.

The volume of inner volume 26 is dependent in part on the total length L and outer dimension D of the tank assembly 12 (see FIG. 4). The sidewall thickness of the tank assembly is expected to be relatively thin, thus having less influence on the internal volume calculation. In one example, the length L is about 14 to 16 inches and the outer dimension D is about 2 to 3 inches to define an internal volume of about 60 to 80 cubic inches when taking into account the internal volume occupied by the baffle assembly 14. The length L and dimension D can vary significantly to provide a wide range of volumes for the tank assembly 12. Further, additional shapes besides the generally cylindrical shape shown with reference to FIGS. 1-4 are possible. For example, spherical, hemispherical, conical, and other shapes are all possible for the tank assembly 12. Any of these example constructions can be configured to receive a spiral shaped baffle having a substantially circular cross-section that provides for desired liquid flow within the liquid storage tank assembly. One further example construction is a hybrid serpentine tank that includes a spiral baffle inserted in one or more of the linear sections of the tank.

The baffle assembly 14 includes a shaft 40 and a helical member 42. The shaft 40 includes first and second open ends 44, 46, and inner volume 48, and an outer peripheral surface 50. The shaft 40 is constructed to permit a liquid flow between the first and second open ends 44, 46 via the internal volume 48. The first and second open ends 44, 46 are aligned with the first and second pass through apertures 34, 38 of the first and second end caps 18, 20, respectively. As shown with reference to FIG. 3, the inner volume 48 of the shaft 40 can provide a pass through channel for liquids to pass through the liquid storage tank assembly 10 without engaging the helical member 42. The end caps 18, 20 can be modified (e.g., see FIG. 5) to provide alternative uses of the inner volume 48 of the shaft 40.

The helical member 42 includes first and second opposed flow surfaces 52, 54 and an outer body engagement surface 56. The helical member 42 is positioned on the outer peripheral surface 50 of the shaft 40. In the arrangement shown with reference to FIGS. 1-4, the helical member 42 is formed integral with the shaft 40. However, other arrangements can provide for a separately formed shaft 40 and helical member 42 that are secured together in a separate assembly step. In one example, a separately formed helical member 42 can be secured to the shaft 40 using, for example, an adhesive, sonic welding, heat bonding, or other attachment method.

The helical member 42 can be secured to the inner surface 30 of the body 16 along the outer body engagement surface 56 of the helical member 42. In one example, the outer body engagement surface 56 is secured to the inner surface 30 using an adhesive. In another example, the surfaces 56, 30 are secured together with a spin weld or a heat bond. In some examples, the surfaces 56, 30 are spaced apart from each other along at least a portion of the surface 56. Other methods and structures can be used to retain the helical member 42 relative to the tank assembly 12.

Figure 2:
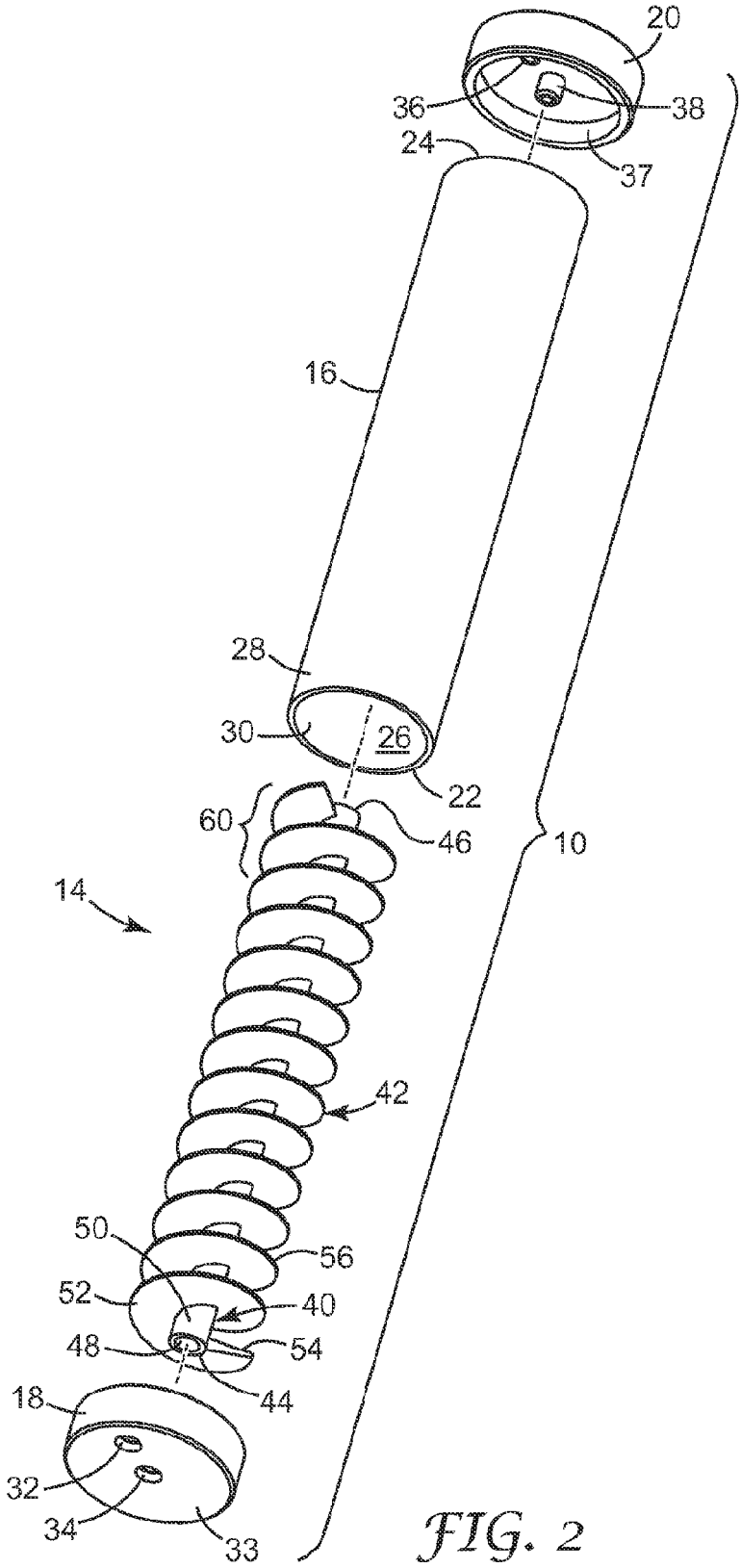
FIG. 2 is a schematic exploded perspective view of the example liquid storage tank assembly shown in FIG. 1.

The helical member 42 is made up of a plurality of full rotation portions 60 that extend 360° around the shaft 40 (see FIG. 2). Multiple rotation portions 60 can be positioned end-to-end to form a continuous helical piece. The helical member 42 shown with reference to FIGS. 1-4 includes about 12 full rotation portions 60. The helical member 42 has a pitch angle $\alpha$ relative to an axis D that extends perpendicular to the shaft 40 (see FIG. 3A). The pitch angle $\alpha$ is shown in the example of FIGS. 2-5 is constant along the shaft 40 for each spiral of the helical member 42. The pitch angle $\alpha$ is typically in the range of about 10° to about 60°, inclusive, and more preferably about 15° to about 40°, inclusive. In the illustrated example of FIGS. 1-5, the angle $\alpha 1$ is about 20°. Typically, as the tank length is decreased, the number of spirals needed to maintain volume efficiency increases and the pitch angle $\alpha$ decreases.

Figure 3A:
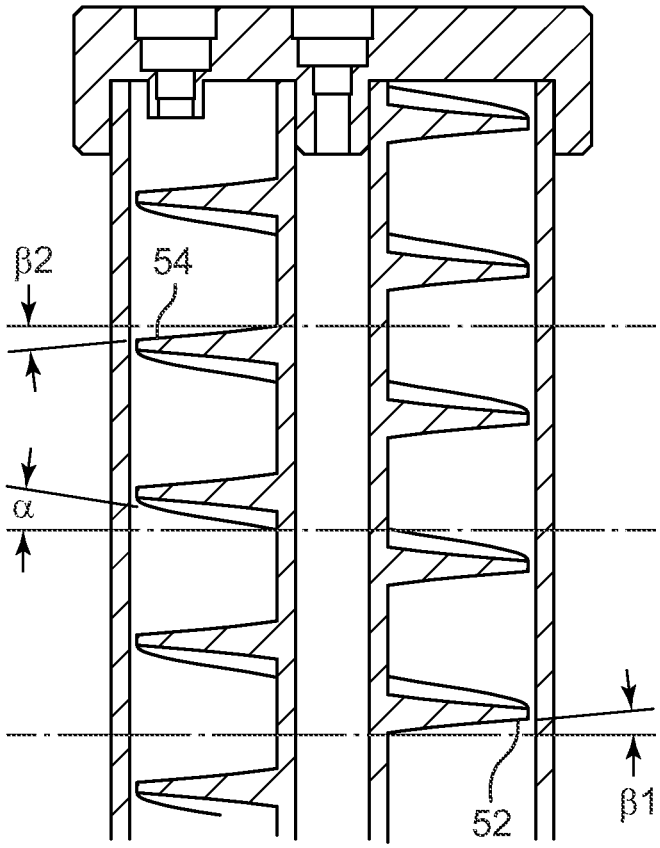
FIG. 3A is a schematic cross-sectional side view of the example liquid storage tank assembly shown in FIG. 1 illustrating a pitch angle of a helical member of the baffle assembly.

The first and second flow surfaces 52, 54 can each be arranged at angles $\beta 1$, $\beta 2$, respectively, relative to the axis D (see FIG. 3A). The angles $\beta 1$, $\beta 2$ are typically constant at each radial position around a circumference of the shaft 40.

The liquid storage tank assembly 10 defines a liquid spiral flow path A as shown in FIG. 4. FIG. 4 illustrates a portion of the body 16 as transparent in order to illustrate the flow path A. The flow path A is defined by the inner surface 30 of the body 16, the first and second end caps 18, 20, the first and second opposed flow surfaces 52, 54 of the helical member 42, and the outer peripheral surface 50 of the shaft 40. A liquid entering the inner volume 26 of the body 16 via one of the first and second liquid apertures 32, 36 of the first and second end caps 18, 20, respectively creates a "front" that travels along the flow path A to the opposing end of the body 16. When the inner volume 26 is filled with a volume of a first liquid (e.g., a volume of water which is then allowed to chill with refrigeration) an inflow of a second liquid (e.g., a volume of unchilled water) into the first liquid aperture 32 creates a front that tends to push the existing volume of first liquid along the liquid flow path A and out of the second liquid aperture 36. This type of liquid flow can be described as a "first in, first out" phenomena in which substantially all of the existing first liquid (e.g., chilled water) exits the second liquid aperture 36 prior to the second liquid (e.g., unchilled water) exiting the second liquid aperture 36.

There are several variables that can influence how effective the "front" of the second liquid along the flow path A is at minimizing mixing of the first liquid with the second liquid. In the application of a refrigerator water storage tank, keeping the first and second liquid separated during dispensing of chilled water from the storage tank can help maintain a desired chilled temperature of the dispensed water until all of the first liquid (chilled water) has been dispensed during a continuous dispense cycle wherein the second liquid (unchilled water) is being drawn into the storage tank.

Some example variables that influence mixing of the first and second liquids at the "front" of the second fluid include the temperature, viscosity, density and velocity of the liquids, the cross-sectional shape and size of the "front", and the inlet and outlet pressure conditions of the tank assembly. At least some of these variables can influence a Reynolds number of the liquids. The Reynolds number represents the type of flow (i.e., laminar or turbulent flow) along the flow path A. Whether flow along the flow path A develops laminar flow gradients can influence how much mixing occurs between the first and second liquids at the "front". Modification of at least some of the variables can be done to optimize the desired "first in, first out" phenomenon described above.

The term "chilled" as it relates to the liquid held in the liquid storage tank assembly 10 can be defined as having a temperature that is less than the temperature of the "unchilled" liquid held in the assembly 10. In one example, the chilled liquid has a temperature substantially the same as the temperature of the refrigerated environment in which the liquid storage tank assembly 10 resides. Some example temperatures for common refrigerated environments is less than 15° C., such as in the range of about 5° C. to 15° C., and more preferably about 5° C. to 10° C. In one example, the unchilled liquid has a temperature in the range from common tap water (e.g., about 15° C. to 20° C.) to room temperature (e.g., about 20° C. to 23° C.).

The use of a spiral or helical shaped baffle assembly 14 in the liquid storage tank assembly 10 can also provide increased volume efficiency over some other water storage tank assembly designs. Volume efficiency is the ratio of the total volume occupied by the storage tank assembly (for example, in the refrigerator) to the liquid volume capacity of the storage tank. The use of a spiral or helical shaped baffle assembly 14 in the liquid storage tank assembly 10 can also provide increased percent volume efficiency over some other water storage tank assembly designs. Percent volume efficiency is the fluid volume capacity of the storage tank divided by the total volume occupied by the storage tank assembly (for example, in the refrigerator), multiplied by 100. For purposes of illustrating the improved percent volume efficiency provided when using a spiral or helical shaped baffle assembly (e.g., baffle assembly 14 in liquid storage tank assembly 10), the percent volume efficiency of several liquid storage tank constructions are compared as follows:

Comparative Example C1

Coil Tank Available from Haier American Trading, LLC, New York, N.Y.

| | |
|---|---|
| Fluid Volume Capacity: | 30.5 $in^3$ (500 mL) |
| Volume of Space Occupied: | 98.4 $in^3$ (1612.5 mL) |
| Percent Volume Efficiency: | 31.0% |

Comparative Example C2

Serpentine Tank Available from Maytag Corp., Benton Harbor, Mich.

| | |
|---|---|
| Fluid Capacity: | 77.5 $in^3$ (1270 mL) |
| Volume of Space Occupied: | 332 $in^3$ (5440.5 mL) |
| Percent Volume Efficiency: | 23.3% |

Example 1

Figure 10:
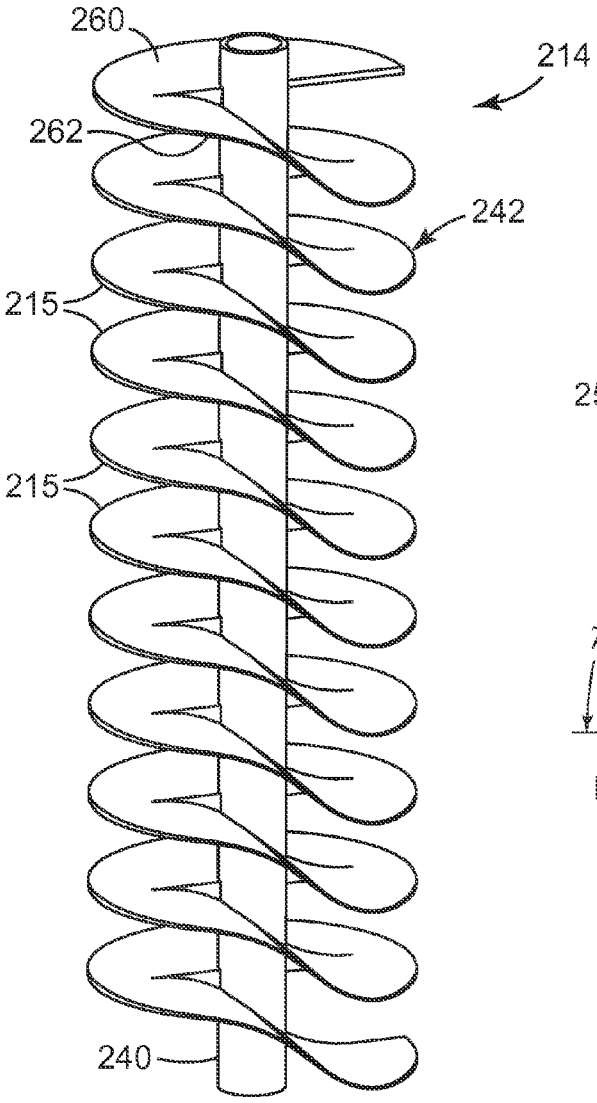
FIG. 10 is a schematic perspective view of another example baffle assembly for use with the storage tank assembly of FIG. 6, wherein the helical member of the baffle assembly includes a variable pitch.

Spiral Baffle Tank as Seen in FIG. 10

| | |
|---|---|
| Fluid Capacity: | 100.7 $in^3$ (1650 mL) |
| Volume of Space Occupied: | 122.6 $in^3$ (2009 mL) |
| Percent Volume Efficiency: | 82.1% |

Comparison of these three examples illustrates that the percent volume efficiency of the spiral baffle tank is about two times more efficient than that of the coil tank and about three times more efficient than that of the serpentine tank.

The construction of liquid storage tank assembly 10 can also provide for a limited pressure drop between the inlet and outlet (e.g., first and second liquid apertures 32, 36) relative to the volume of water stored in the liquid storage tank assembly 10. Minimizing the pressure drop provides for improved speed of dispensing the liquid to the user.

Figure 5:
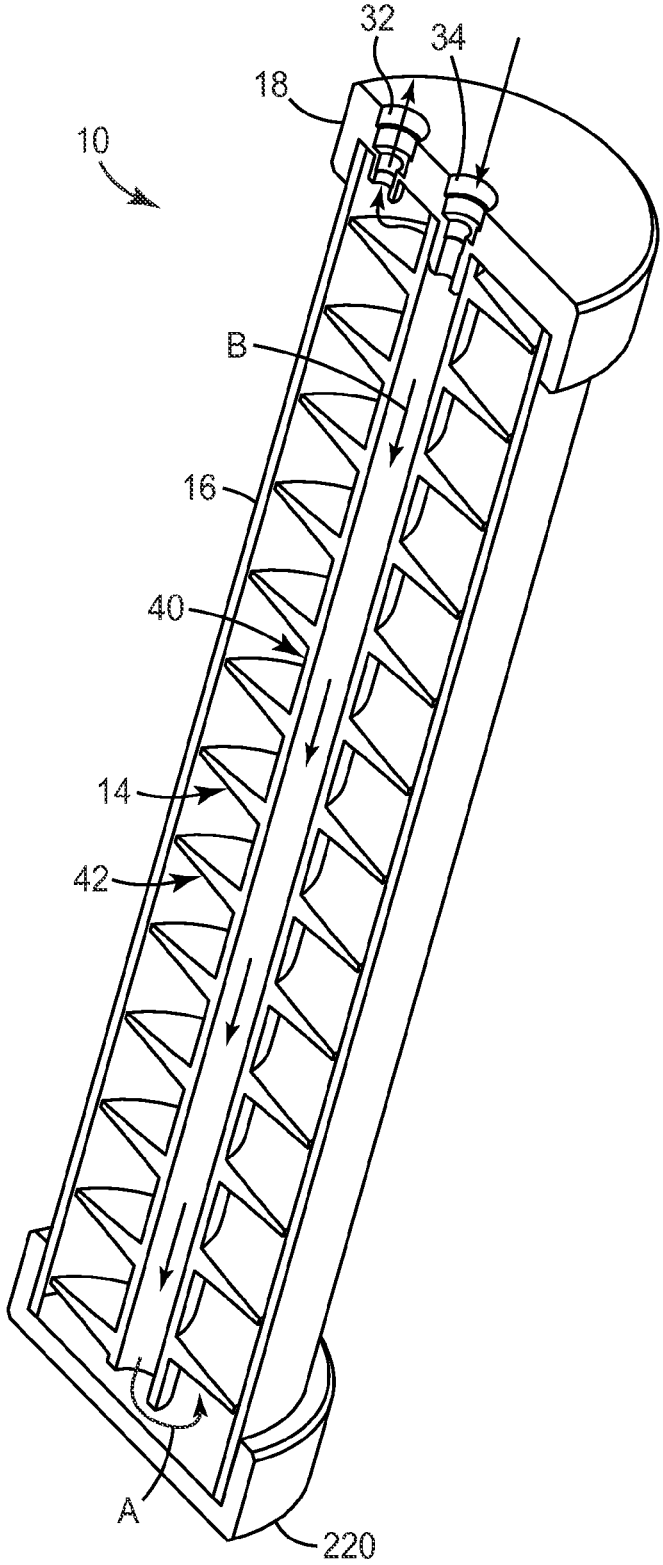
FIG. 5 is a schematic cross-sectional perspective view of another example liquid storage tank assembly having the inlet and outlet of the liquid storage tank assembly defined at the same end of the storage tank assembly.

Referring now to FIG. 5, an alternative end cap construction 220 is shown. The end cap 220 provides a liquid flow path between the inner volume 48 of the shaft 40 and the liquid spiral flow path A along the helical member 42. FIG. 5 illustrates a flow of liquid along a flow path B defined within the inner volume 48 of the shaft 40. The end cap 220 is constructed to provide for the flow B to enter into the spiral flow path A. The liquid travels along the spiral flow path A until exiting the first liquid aperture 32 of the first end cap 18. The liquid storage tank assembly shown in FIG. 5 permits positioning of the inlet (first pass through aperture 34) and outlet (first liquid aperture 32) at the same end portion of the liquid storage tank assembly 10 (i.e., the end cap 18). Alternatively, the first liquid aperture 32 can be used as the inlet and the first pass through aperture 34 can be used as the outlet of the liquid storage tank assembly 10 shown in FIG. 5.

Figure 6:
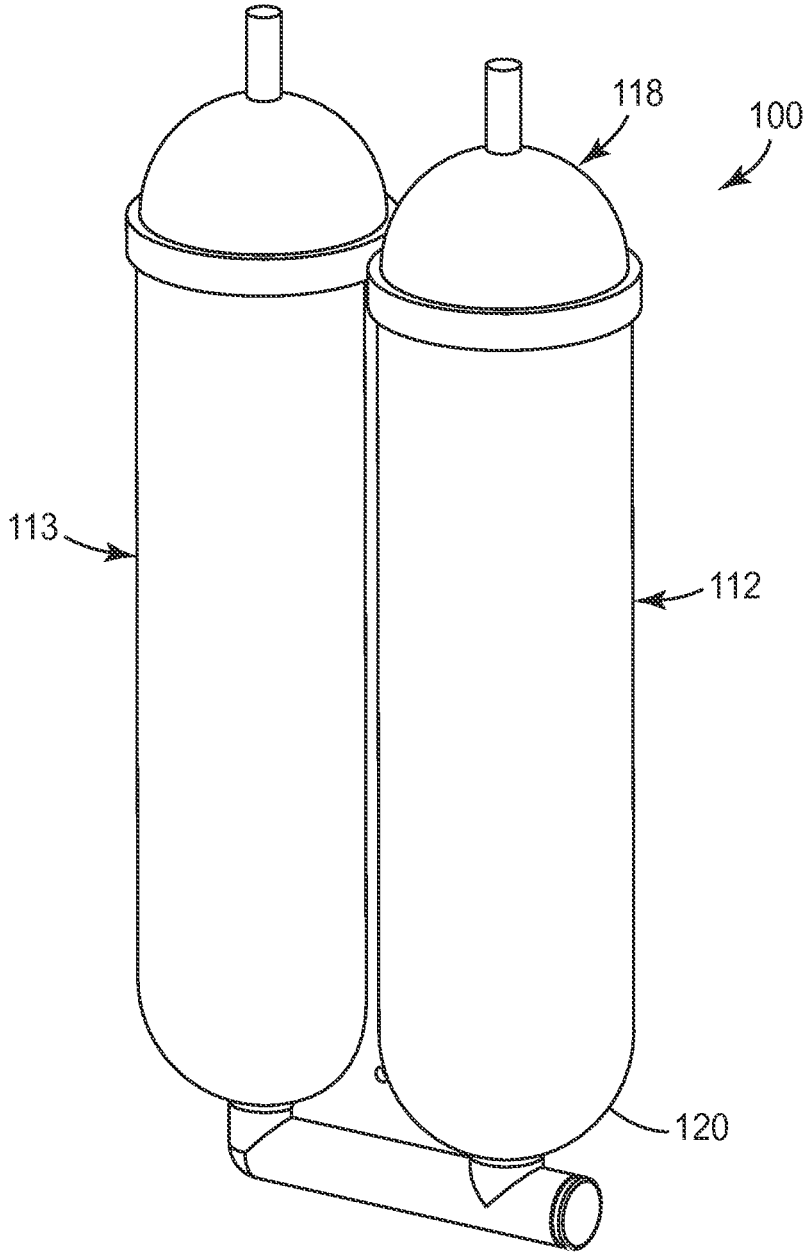
FIG. 6 is a schematic perspective view of another example liquid storage tank assembly in accordance with principles of the present disclosure.
Figure 7:
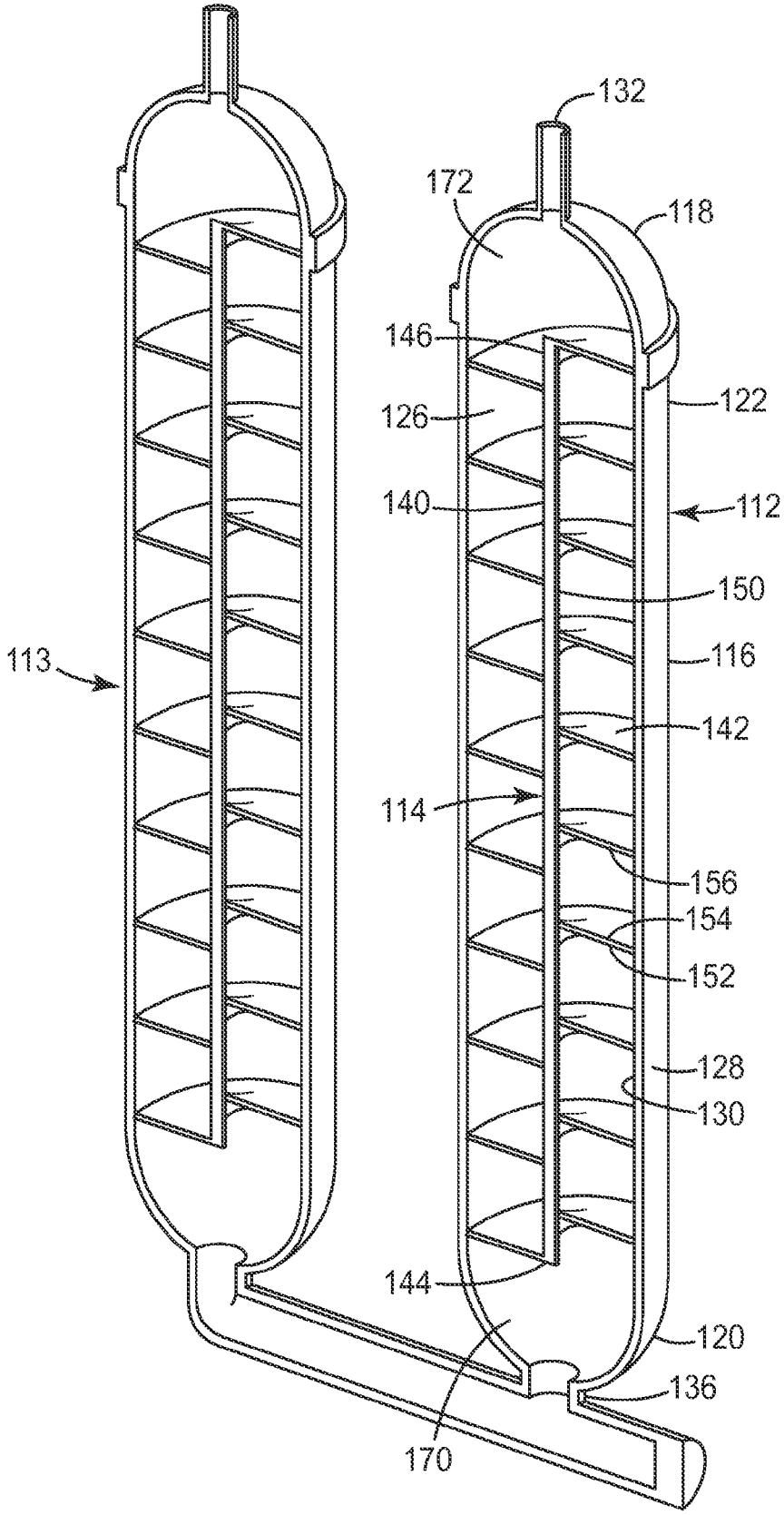
FIG. 7 is a schematic cross-sectional perspective view of the example liquid storage tank assembly shown in FIG. 6.
Figure 8:
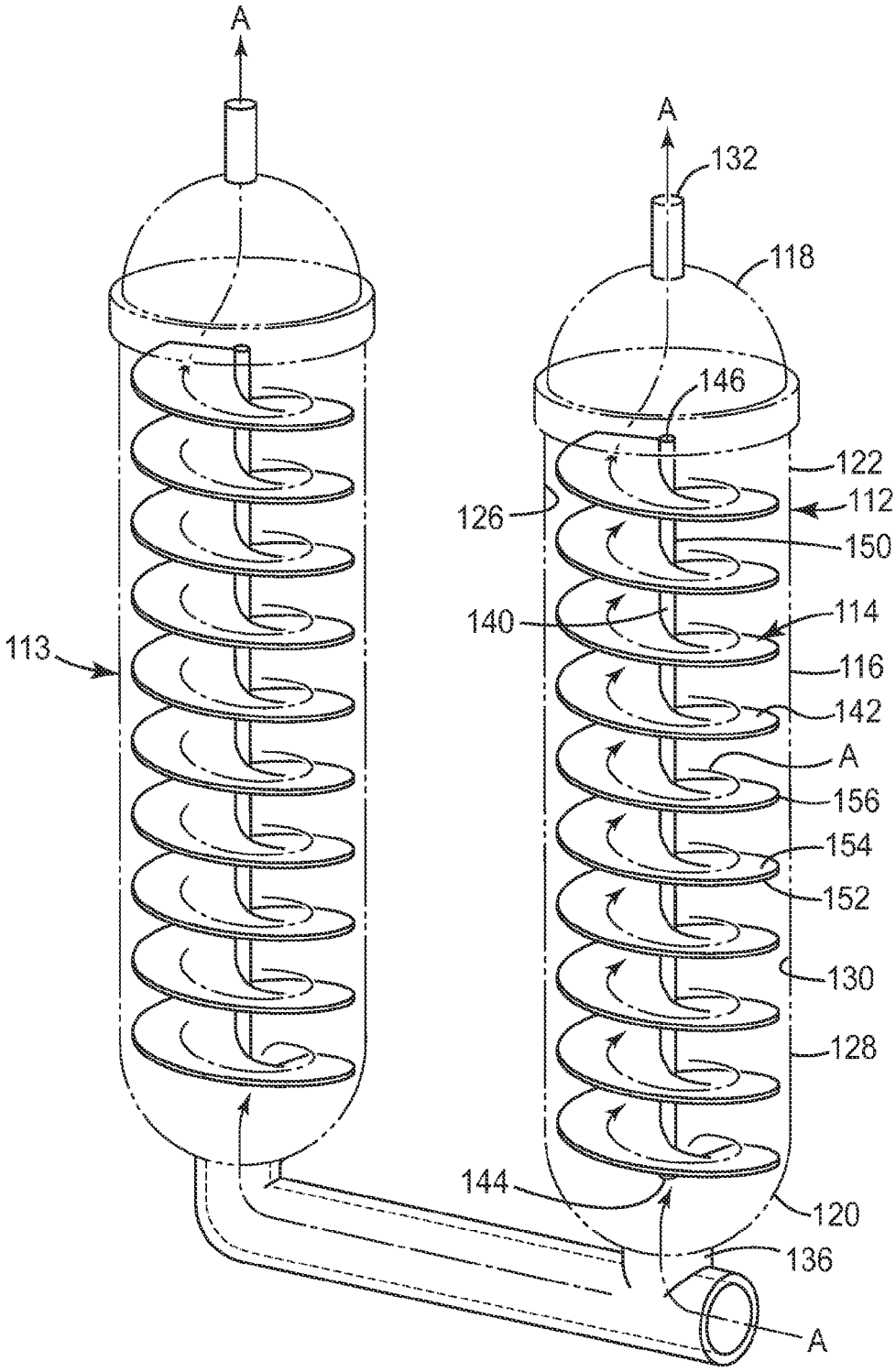
FIG. 8 is a schematic perspective view of the example liquid storage tank assembly shown in FIG. 6 with portions of the tank assembly shown opaque to illustrate an example parallel liquid flow path through the liquid storage tank assembly.

The Example Liquid Storage Tank Assembly of FIGS. 6-8

Referring now to FIGS. 6-8, another example liquid storage tank assembly 100 is shown and described. The liquid storage tank assembly 100 includes first and second tank assemblies 112, 113 each including a baffle assembly 114 positioned therein. The tank assemblies 112, 113 are shown as a pair having identical constructions. In other arrangements, a single tank assembly (such as the tank assembly 10 described with reference to FIGS. 1-5) or at least three tank assemblies can be included in a given liquid storage tank assembly. The features of tank assembly 112 are labeled in the Figures for purposes of the following description.

The tank assembly 112 includes a body 116 having a first open end 122, an inner volume 126 defined therein, an outer peripheral surface 128, and an inner surface 130 (see FIGS. 7 and 8). The tank assembly 112 also includes first and second end caps 118, 120. The first end cap 118 is constructed as a separate piece that is mounted to the body 116 in a separate step after positioning of the baffle assembly 114 within the inner volume 126. The first end cap 118 defines a first liquid aperture 132.

The second end cap 120 is constructed integral with the body 116. The second end cap 120 defines a second liquid aperture 136. Each of the first and second end caps 118, 120 defines a generally hemispherical shape. The overall tank assembly 112 is shaped like a common pressure vessel that is an elongate cylinder with hemispherical ends. The tank assembly 112 is constructed to withstand substantial internal pressure conditions for a given material used and the thickness of the material.

The baffle assembly 114 includes a shaft 140 and a helical member 142. The shaft 140 includes first and second ends 144, 146 and an outer peripheral surface 150 to which the helical member 142 is mounted. The helical member 142 includes first and second flow surfaces 152, 154 and an outer body engagement surface 156.

An axial position of the baffle assembly 114 within the inner volume 126 can be maintained by, for example, providing an interference fit or a connection between the helical member 142 and the inner surface 130 of the body 116. In one example, the outer body engagement surface 156 is spun welded to the inner surface 130. In another example, an adhesive, heat welding, or other structure or connecting method is used to fix a position and orientation of the baffle assembly 114 relative to the tank assembly 112. The baffle assembly 114 can also be secured to the body 116 via a connection or engagement between the shaft 140 and features of the body.

The baffle assembly 114 defines a liquid spiral flow path A within the inner volume 126 of the body 116. FIG. 8 illustrates the liquid spiral flow path A through the first storage tank assembly 112 in a direction from the second liquid aperture 136 to the first liquid aperture 132. FIG. 8 further illustrates flow path A directed in a parallel path through the second storage tank assembly 113. Alternatively, the liquid flow path A can be directed in the opposite direction through either of the storage tank assemblies 112, 113 between the first liquid aperture 132 and the second liquid aperture 136 as shown in storage tank assembly 12 in FIG. 9. The first and second end caps 118, 120 define chambers 170, 172 (see FIG. 7) adjacent to the first and second liquid apertures 132, 136, respectively and the liquid flow path A defined by the baffle assembly 114. These chambers are substantially eliminated in the liquid storage tank assembly 10 described with reference to FIGS. 1-5 above. In some arrangements, the baffle assembly 114 can extend into the chambers 170, 172 to extend the liquid flow path A closer the liquid apertures 132, 136.

Figure 9:
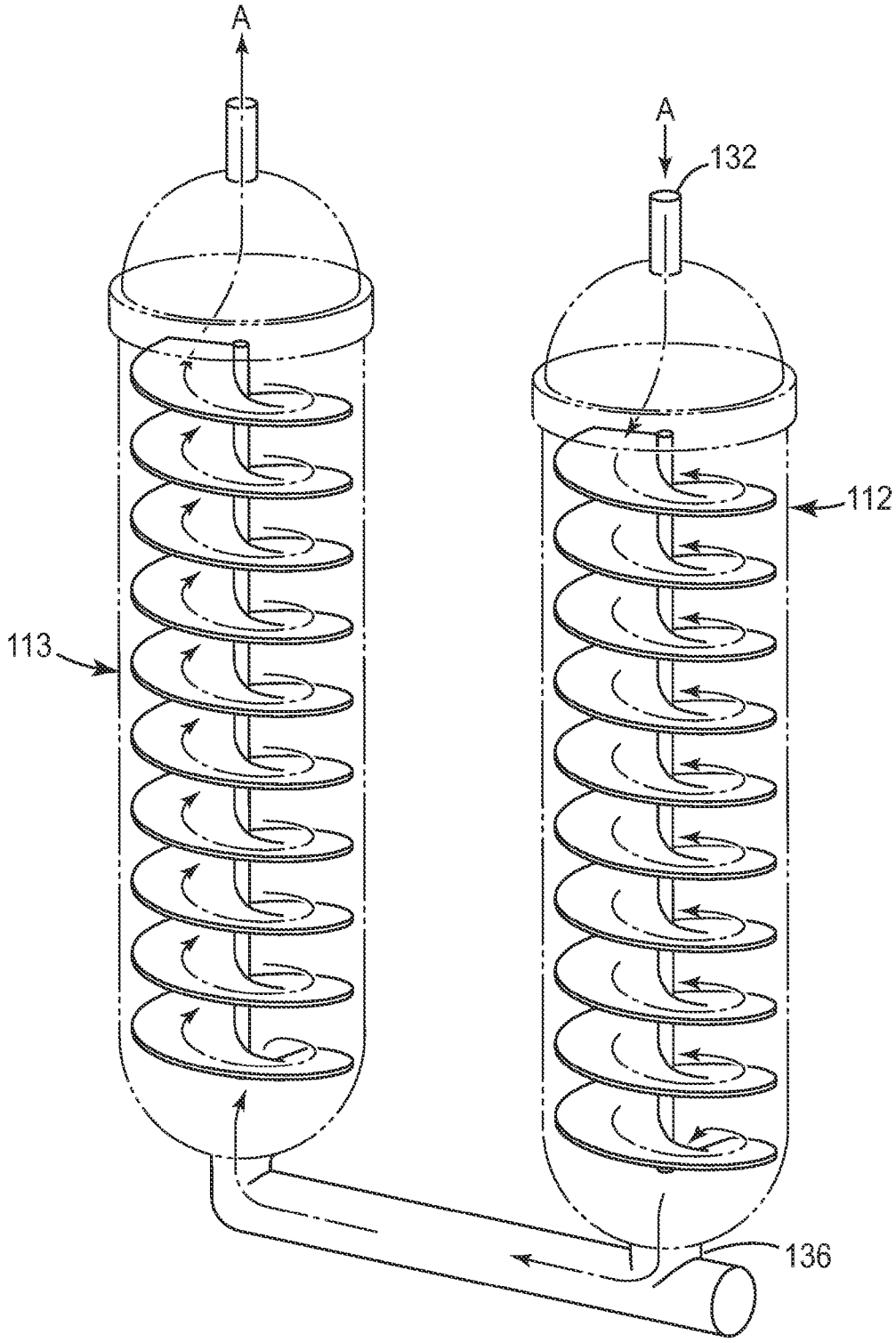
FIG. 9 is a schematic perspective view of the example liquid storage tank assembly shown in FIG. 6 with portions of the tank assembly shown opaque to illustrate an example serial liquid flow path through the liquid storage tank assembly.

FIG. 9 illustrates an arrangement of the liquid storage tank assemblies 112, 113 in series, wherein liquid flows in a first direction through the first storage tank assembly 112 and then passes into the second storage tank assembly 113 wherein flow occurs in an opposite direction. While two liquid storage tank assemblies are shown in FIGS. 6-9, other arrangements can include three or more liquid storage tank assemblies having parallel fluid flow, series fluid flow, or a combination of parallel and series fluid flow.

The use of multiple relatively long, small diameter liquid storage tank assemblies can provide certain advantages in refrigerated storage environments. For example, a low profile configuration provided by a long, small diameter storage tank configuration can be position within or against a sidewall, bottom wall, or top wall of the refrigerated cavity while causing minimum obstruction to the user. Further, relatively small diameter constructions can provide improved surface area exposure to the stored liquid for purposes of reducing the temperature of the stored liquid as compared to some larger diameter constructions.

Figure 11:
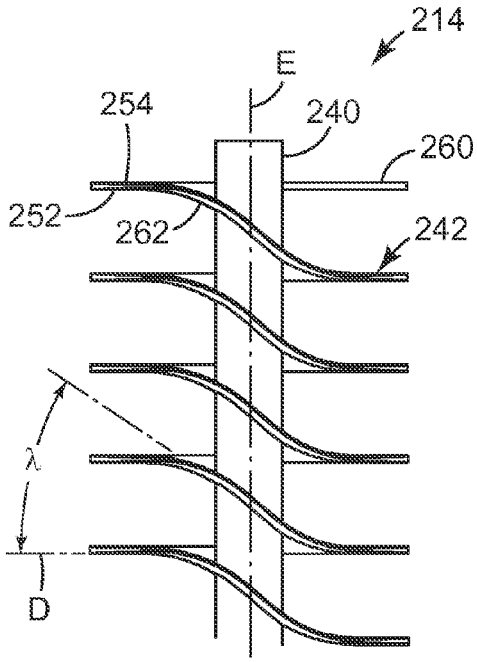
FIG. 11 is a schematic side view of the baffle assembly shown in FIG. 10 illustrating the maximum pitch angle of the helical member.
Figure 12:
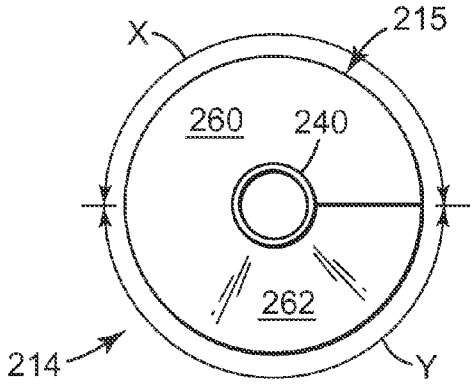
FIG. 12 is a schematic top view of the baffle assembly shown in FIG. 10.

FIGS. 10-12 illustrate another example baffle assembly 214. The baffle assembly 214 includes a helical member 242 and shaft 240. The helical member 242 includes first and second flow surface 252, 254. The helical member 214 defines a plurality of spiral members 215 that each extend around the shaft 240 one full 360° rotation (see FIG. 12). Each spiral member 215 of the helical member 242 has a pitch angle that changes around the baffle shaft 240. That is, each spiral member 215 includes at least two different pitch angles. In the example of FIGS. 10-12, each spiral member 215 has the same configuration with the same pitch angles. In other arrangements, at least some of the spiral members can be configured differently with different pitch angles, or with similar pitch angles that are positioned at different orientations around the shaft 240.

The pitch of the spiral members 215 may vary from substantially parallel to an axis E of the shaft 240 to substantially parallel with the perpendicular axis D (see FIG. 11). The spiral members 215 shown in FIGS. 10-12 include a first portion 260 that is planar and arranged parallel with the perpendicular axis D, and a second portion 262 that is arranged at an angle relative to the perpendicular axis D. The first portion 260 extends around the shaft 240 a radial angle X (shown as about 180° in FIG. 12) and the second portion 262 extends around the shaft 240 a radial angle Y (also shown as about 180° in FIG. 12). A pitch angle λ of the first portion 260 is defined as 0°. The pitch angle λ of the second portion 262 is greater than 0°. Thus, the spiral member 215 includes at least two different pitch angles, which can also be defined as a variable pitch for a given spiral member. The pitch angle λ for each of the first and second portions 260, 262 can vary while preferably not being equal to each other and constant around the radial angles X, Y. Further, each spiral member 215 can includes more than two portions, each including a different pitch angle λ.

The second portion 262 includes at least two different pitch angles λ around the radial angle Y. The pitch angle λ of the second portion 262 is shown ranging from about 0° to about 45°, inclusive. In other examples, the pitch angle λ of either of the first or second portions 260, 262 can vary between 0° and 90°, inclusive, and more preferably in the range of about 0° and 60°, inclusive. Typically, as the tank length is decreased, the number of spirals needed to maintain volume efficiency increases and the average variable pitch decreases The liquid storage tank assembly described herein may contain a constant pitch helical member over the length of the baffle assembly, a variable pitched helical member over the length of the baffle assembly, variable pitched spiral members of the helical member, or any combination thereof to achieve a specific desired flow outcome.

The example liquid storage tank assemblies 10, 100 described herein can be constructed of various materials depending on the desired physical property or performance characteristic desired. For example, the body 16, 116 can include a metal material (e.g., ferrous or non-ferrous (brass, bronze, aluminum)) that provides improved heat transfer with the volume of liquid held in the inner volume 26, 126. The body 16, 116 can alternatively include a polymer material that improves manufacturability and can reduce costs. Some example polymer materials include polypropylene, polyvinyl chloride (PVC), polyethylene and polycarbonate.

The use of polymer materials for all or portions of the tank assembly 12, 112 and baffle assembly 14, 114 can provide for various manufacturing possibilities for the liquid storage tank assemblies 10, 100. For example, the liquid storage tank assembly 10 can be molded from a polymeric material as separate halves (e.g., halves taken along a plane that extends through the longitudinal axis as shown in FIG. 3). Two such halves can then be secured together using, for example, an adhesive or solvent to provide the completed liquid storage tank assembly 10, 100. Any individual portion of the tank assembly and baffle assembly could be constructed using similar techniques.

The liquid storage tank assemblies 10, 100 are adapted to withstand pressures common to the application in which they are used. In the application of a refrigerated water storage tank for one embodiment, the liquid supply pressure is typically in the range of about 10 to about 150 psi, and in other embodiments in the range of about 15 to about 120 psi. In other applications, the pressure condition can be substantially lower or substantially higher. The liquid storage tank assembly can be constructed to withstand pressures multiple times greater than the expected pressure condition (e.g. at least 400 psi) in order to provide a factor of safety that minimizes the chance of failure due to pressure.

CONCLUSION

One aspect of the present disclosure relates to a liquid storage tank assembly that is adapted for use in a refrigerated environment. The assembly includes a tank assembly and a baffle member. The tank assembly includes an inlet and an outlet, and defines an enclosed inner volume. The baffle member is positioned in the enclosed inner volume. The baffle member has a helical construction that defines a helical path in the enclosed inner volume. A flow of liquid entering the inlet is directed towards the outlet by the baffle member along the helical path.

Another aspect of the present disclosure relates to a method of manufacturing a water storage assembly. The water storage assembly is adapted for use in a refrigerated environment such as a refrigerator. The water storage assembly includes a tank assembly and a baffle member. The tank assembly has an inlet and an outlet, and the baffle member has a helical construction. The method includes inserting the baffle member into an inner volume defined by the tank assembly, and sealing closed the tank assembly to enclose the baffle member in the inner volume.

A further aspect of the present disclosure relates to a method of dispensing refrigerated water using a water storage assembly. The water storage assembly includes a tank assembly and a baffle member. The tank assembly has an outlet and an inlet and defines an inner volume. The baffle member has a helical shaped portion and is positioned in the inner volume of the tank assembly to define a helical flow path. The method includes storing a volume of chilled water in the inner volume of the tank assembly, and advancing a volume of unchilled water into the inner volume via the inlet. The volume of unchilled water is advanced along the helical path, wherein advancement of the volume of unchilled water along the helical flow path forces the volume of chilled water along the helical path and out of the outlet.

The examples discussed herein have focused on liquid storage tanks and the storage and dispensing of liquids. It is expected that the use of these examples with and fluids (e.g., gases, liquids, or liquid/gas mixtures) or mixtures of fluids and solids will provide similar benefits and functionality.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, inventive subject matter lies in less than all features of a single disclosed embodiment. Thus, the following claims are hereby incorporated into the detailed description, with each claim standing on its own as a separate preferred embodiment. Therefore, the sphere and scope of the appended claims should not be limited to the description of the preferred versions contained herein.

We claim:

1. A liquid storage tank assembly adapted for use in a refrigerated environment, the assembly comprising:

a tank assembly defining an enclosed inner volume, the tank assembly having an inlet and an outlet; and a baffle member positioned in the enclosed inner volume, the baffle member having a helical construction that defines a helical path in the enclosed inner volume, wherein a flow of liquid entering the inlet is directed towards the outlet by the baffle member along the helical path;

wherein the baffle member includes a shaft and a helical member positioned on the shaft, the helical member extending around the shaft at least one rotation; and wherein the shaft includes a hollow core in flow communication with the helical path.

2. The assembly of claim 1, wherein the helical member includes a constant pitch angle.

3. The assembly of claim 1, wherein the helical member includes a variable pitch angle.

4. The assembly of claim 1, wherein the tank assembly includes first and second opposing end portions, and at least one of the first closed end portion and the second closed end portion comprises a rounded shape.

5. The assembly of claim 4, wherein the first end portion defines the inlet and the outlet.

6. The assembly of claim 4, wherein the first end portion defines the inlet and the second end portion defines the outlet.

7. The assembly of claim 4, wherein one of the first and second end portions is formed integral with the tank and the other of the first and second end portions is provided as a separate piece that is secured to the tank assembly separately.

8. The assembly of claim 1, wherein the tank assembly comprises a polymer material.

9. The assembly of claim 1, wherein the tank assembly has a liquid capacity in the range of about 0.05 gal to about 1 gal.

10. The assembly of claim 1, wherein the helical member extends around the shaft at least 5 rotations.

11. The assembly of claim 1, wherein the tank assembly has a cylindrical construction.

12. A method of manufacturing a water storage assembly, the water storage assembly adapted for use in a refrigerator, the water storage assembly including a tank assembly and a baffle member, the tank assembly having an inlet and an outlet, the baffle member having a helical construction that defines a helical path and the baffle member comprising a shaft and a helical member, the helical member extending around the shaft at least one rotation and the shaft including a hollow core in flow communication with the helical path, the method comprising:

inserting the baffle member into an inner volume defined by the tank; and sealing closed the tank to enclose the baffle member in the inner volume.

13. The method of claim 12, wherein sealing closed the tank includes positioning an end cap on the tank.

14. The method of claim 12, further comprising securing the baffle member to the tank assembly prior to sealing closed the tank assembly.

15. A method of dispensing refrigerated water using a water storage assembly, the water storage assembly including a tank assembly and a baffle member, the tank assembly having an outlet and an inlet and defining an inner volume, the baffle member having a helical construction that defines a helical path and the baffle member comprising a shaft and a helical member, the helical member extending around the shaft at least one rotation and the shaft including a hollow core in flow communication with the helical path, the method comprising:

storing a volume of chilled water in the inner volume of the tank; and advancing a volume of unchilled water into the inner volume via the inlet, the volume of unchilled water being advanced along the helical path, wherein advancement of the volume of unchilled water along the helical flow path forces the volume of chilled water along the helical path and out of the outlet.

16. The method of claim 15, wherein advancing the volume of unchilled water includes minimizing mixing of the chilled and unchilled water.

17. The method of claim 15, wherein advancing the volume of unchilled water includes supplying the volume of unchilled water at a pressure condition of about 10 psi to about 150 psi.

18. The method of claim 15, wherein storing the volume of chilled water includes storing a volume of about 0.05 gal to about 1.0 gal of water.

* * * * *